US011602941B2

(12) United States Patent
Tsuji

(10) Patent No.: US 11,602,941 B2
(45) Date of Patent: Mar. 14, 2023

(54) PRINTING DEVICE HAVING CUTTING UNIT FOR SEPARATING PRINTING MEDIUM INTO FIRST AND SECOND MEDIA, AND ACCOMMODATING UNIT FOR ACCOMMODATING THEREIN SECOND MEDIUM

(71) Applicant: BROTHER KOGYO KABUSHIKI KAISHA, Nagoya (JP)

(72) Inventor: Takuya Tsuji, Chiryu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/206,438

(22) Filed: Mar. 19, 2021

(65) Prior Publication Data

US 2021/0300085 A1 Sep. 30, 2021

(30) Foreign Application Priority Data

Mar. 31, 2020 (JP) ..... JP2020-064044

(51) Int. Cl.
*B41J 11/70* (2006.01)
*B41J 11/66* (2006.01)

(52) U.S. Cl.
CPC ..... *B41J 11/706* (2013.01); *B41J 11/663* (2013.01)

(58) Field of Classification Search
CPC ..... B41J 11/706; B41J 11/663; B65H 35/06; B65H 85/00; B65H 2301/51; B65H 2301/4454; B65H 2301/446; B65H 29/58; B65H 2404/631; B65H 54/2857
See application file for complete search history.

(56) References Cited

U.S. PATENT DOCUMENTS 5,897,251 A * 4/1999 Kato ..... G03G 15/231 399/408
8,246,160 B2 * 8/2012 Uchida ..... B41J 3/60 271/186

(Continued)

FOREIGN PATENT DOCUMENTS

JP 2018-186448 A 11/2018

*Primary Examiner* — Jennifer Bahls
*Assistant Examiner* — Quang X Nguyen
(74) *Attorney, Agent, or Firm* — Scully, Scott, Murphy & Presser, PC

(57) ABSTRACT

A printing device includes: a casing; a first accommodating unit accommodating therein a printing medium; an image recording unit; a cutting unit; a supporting unit; a second accommodating unit; a first conveying passage; and a second conveying passage branching from the first conveying passage. The image recording unit is configured to record an image on the printing medium. The cutting unit is configured to divide the printing medium into a first medium and a second medium. The supporting unit is configured to support the printing medium conveyed in a first direction. The printing medium accommodated in the first accommodating unit is conveyed to the supporting unit along the first conveying passage. The second accommodating unit is positioned upstream of the image recording unit in the first direction and configured to accommodate therein the second medium. The second medium is conveyed to the second accommodating unit along the second conveying passage.

16 Claims, 8 Drawing Sheets

(56) References Cited

U.S. PATENT DOCUMENTS

| | | | | |
|---|---|---|---|---|
| 2006/0066021 | A1* | 3/2006 | Sasahara | B42C 1/12 270/58.11 |
| 2013/0134016 | A1* | 5/2013 | Uchino | B65H 5/062 198/722 |
| 2013/0271544 | A1* | 10/2013 | Yajima | B41J 11/70 83/111 |
| 2014/0117610 | A1* | 5/2014 | Aono | B65H 29/125 271/3.18 |

* cited by examiner

PRINTING DEVICE HAVING CUTTING UNIT FOR SEPARATING PRINTING MEDIUM INTO FIRST AND SECOND MEDIA, AND ACCOMMODATING UNIT FOR ACCOMMODATING THEREIN SECOND MEDIUM

CROSS REFERENCE TO RELATED APPLICATION

This application claims priority from Japanese Patent Application No. 2020-064044 filed Mar. 31, 2020. The entire content of the priority application is incorporated herein by reference.

TECHNICAL FIELD

The present disclosure relates to a printing device.

BACKGROUND

A conventional image forming apparatus is provided with an image forming unit for forming images on sheets, and a sheet conveying unit for conveying sheets to the image forming unit. When the image forming apparatus receives a job, the sheet conveying unit conveys a sheet in a sheet feeding cassette to the image forming unit, and the image forming unit forms an image on the sheet. At this time, the size of the sheet specified by the job may be smaller than the size of the sheets loaded in the sheet feeding cassette. In such cases, a user must reset sheets having the size specified in the job in the sheet feeding cassette, which leads an inconvenience for the user.

Japanese Patent Application Publication No. 2018-186448 describes an image forming apparatus provided with a first feeding cassette for accommodating therein first sheets and a second feeding cassette for accommodating therein second sheets having the size larger than that of the first sheets. When the first feeding cassette is out of the first sheets specified in a job, the image forming apparatus forms images on the second sheets in the second feeding cassette. After forming an image on the second sheet having a larger size than the first sheet, the conventional image forming apparatus cuts the second sheet in half to generate a sheet on which the image has been formed and a blank sheet those have the same size as the first sheet. Then, the sheet on which the image has been formed is discharged into a first discharging tray, and the blank sheet having no image formed thereon is accommodated in the first feeding cassette by a user. Thus, when a subsequent job specifies a sheet size equivalent to the size of the first sheet, the image forming apparatus can reuse the blank sheet accommodated in the first feeding cassette.

SUMMARY

However, since two feeding cassettes of the same size (i.e., the first feeding cassette and the second feeding cassette) must be provided in the image forming apparatus in Japanese Patent Application Publication No. 2018-186448, there is some room for making the image forming apparatus more compact.

In view of the foregoing, it is an object of the present disclosure to provide a more compact printing device that can cut a printing medium and use the cut printing medium.

In order to attain the above and other object, according to one aspect, the present disclosure provides a printing device including: a casing; a first accommodating unit; an image recording unit; a cutting unit; a supporting unit; a second accommodating unit; a first conveying passage; and a second conveying passage. The first accommodating unit is configured to accommodate therein a printing medium. The image recording unit is disposed above the first accommodating unit and configured to record an image on the printing medium. The cutting unit is configured to cut the printing medium to divide the printing medium into a first medium and a second medium. The supporting unit is disposed between the first accommodating unit and the image recording unit in an up-down direction and configured to support a first surface of the printing medium conveyed in a first direction. The second accommodating unit is positioned upstream of the image recording unit in the first direction and configured to accommodate therein the second medium obtained by cutting the printing medium using the cutting unit. The printing medium accommodated in the first accommodating unit is conveyed to the supporting unit along the first conveying passage. The second medium is conveyed to the second accommodating unit along the second conveying passage. The second conveying passage branches from the first conveying passage.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

First Embodiment

<Configuration of Printing Device>

Figure 1:
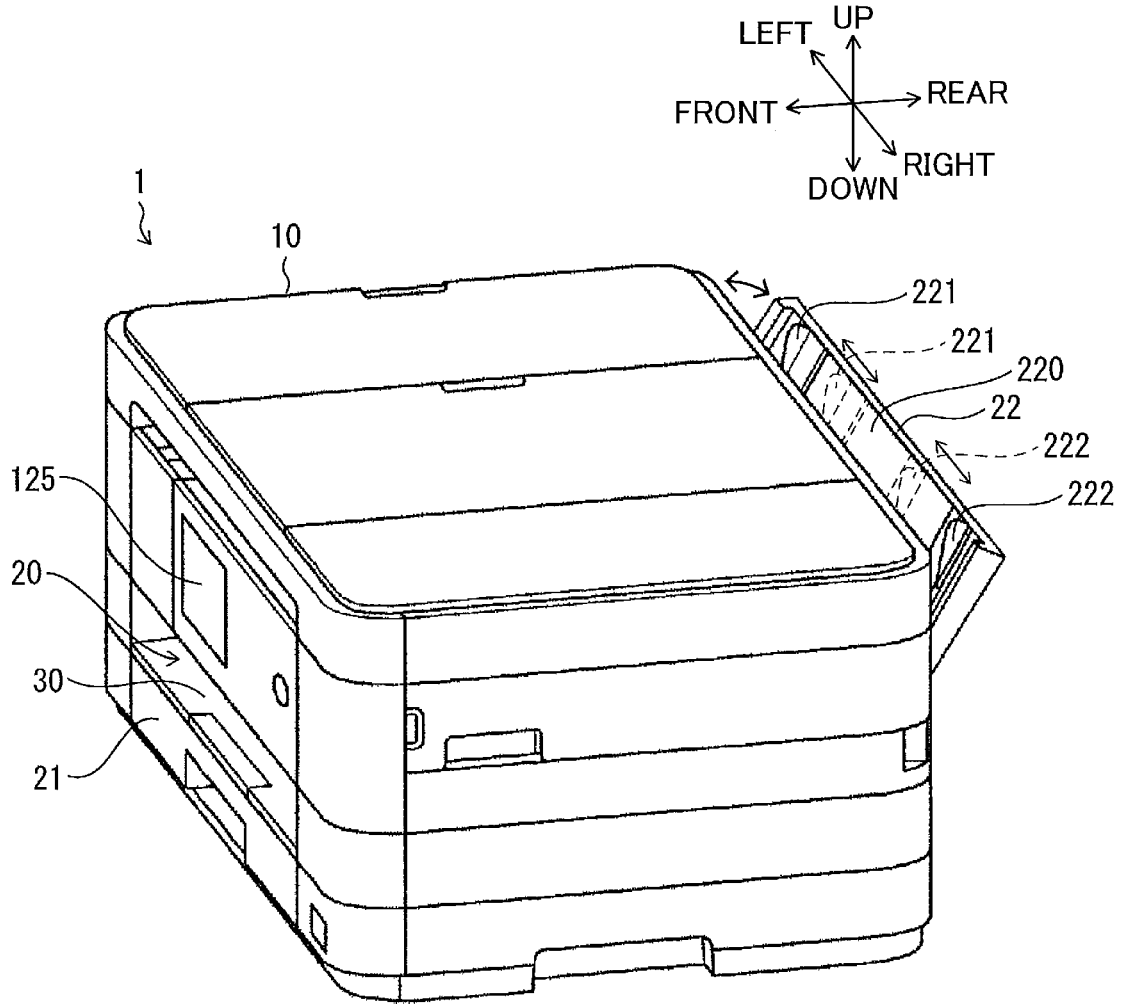
FIG. 1 is a view illustrating an external appearance of a printing device according to a first embodiment of the present disclosure.
Figure 2:
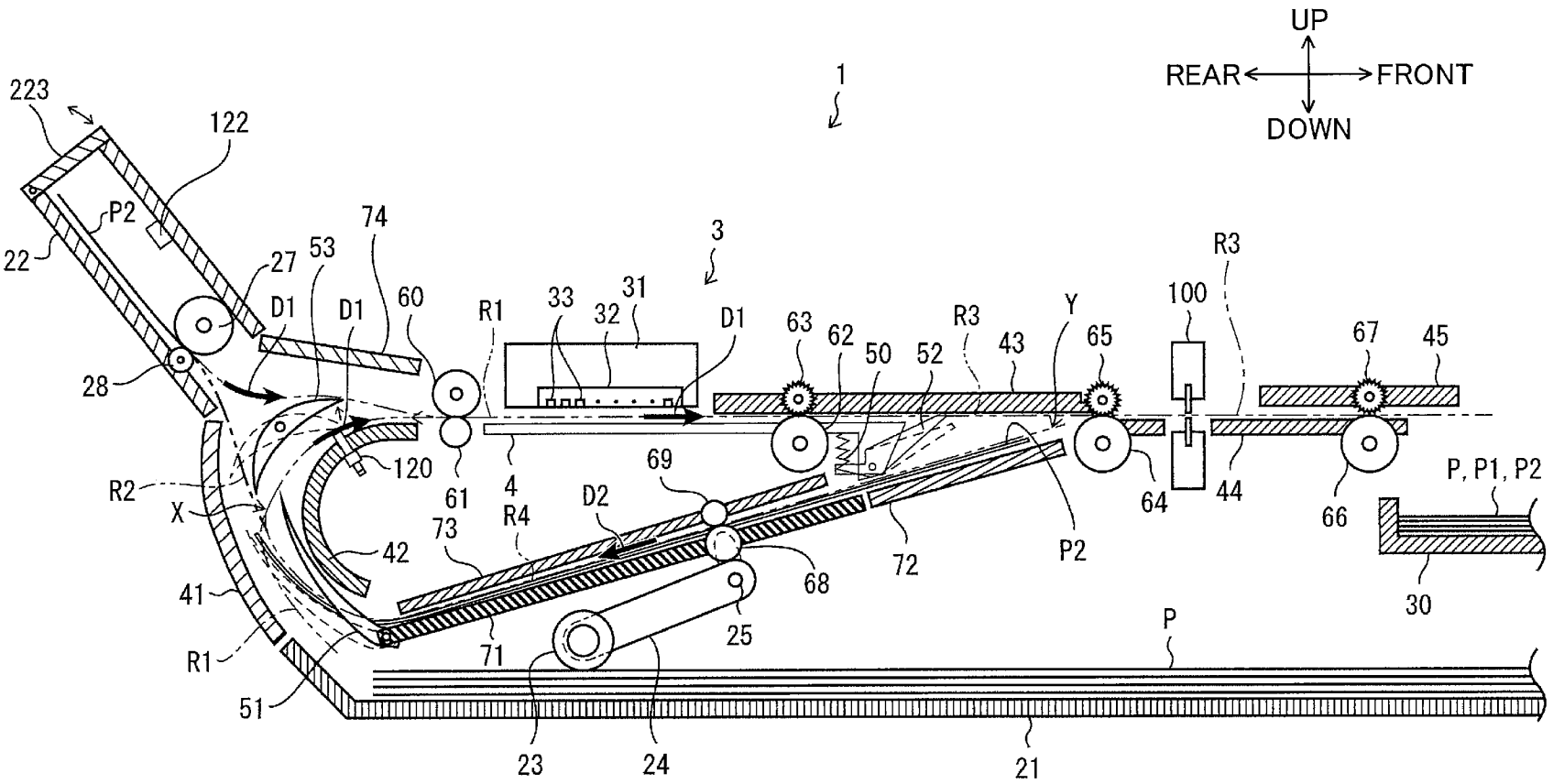
FIG. 2 is a cross-sectional view illustrating an internal configuration of the printing device according to the first embodiment in which a third flap is in its first position.
Figure 3:
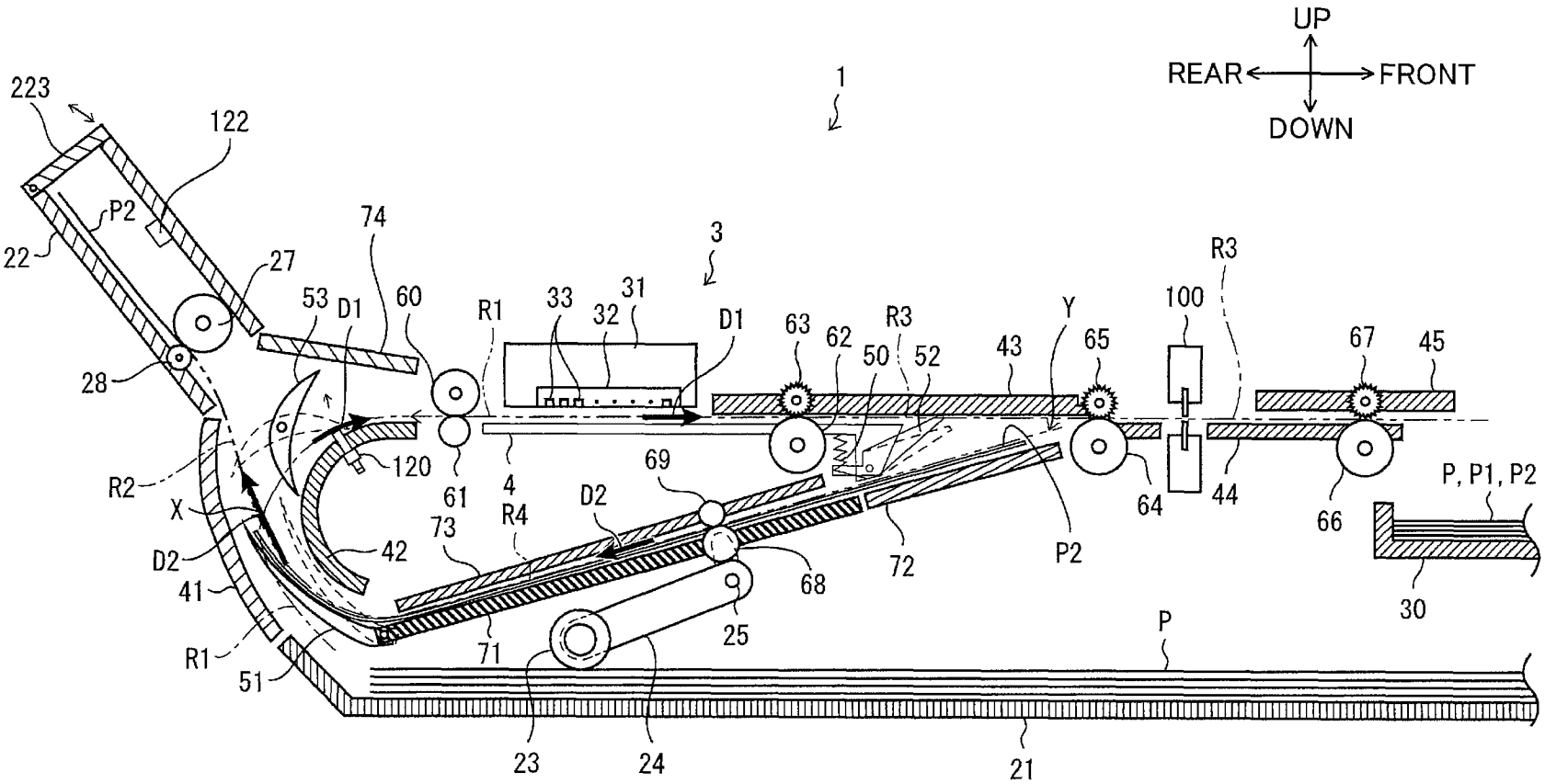
FIG. 3 is a cross-sectional view illustrating the internal configuration of the printing device according to the first embodiment in which the third flap is in its second position.

Hereinafter, a printing device 1 according to a first embodiment of the present disclosure will be described with reference to FIGS. 1 through 7. FIG. 1 illustrates an external appearance of the printing device 1 according to the first embodiment. FIG. 2 is a cross-sectional view illustrating an internal configuration of the printing device 1 in which a third flap 53 is in its first position. FIG. 3 is a cross-sectional view illustrating the internal configuration of the printing device 1 in which the third flap 53 is in its second position.

The printing device 1 in FIG. 1 is a multifunction peripheral (MFP) having a plurality of functions, such as a printing function, a scanning function, a copying function, and a facsimile function. For convenience, an up-down direction, a left-right direction, and a front-rear direction with reference to the printing device 1 are defined as indicated by arrows in FIG. 1.

The printing device 1 has an inkjet printing function for recording print data specified in a print job on sheets P by ejecting ink, for example. However, method of printing is not limited to the inkjet method but may be the electrophotographic method. The printing device 1 may be capable of printing color images or only monochromatic images on sheets P. The sheets P may be a paper medium or a resin medium such as transparency sheets.

As illustrated in FIG. 1, the printing device 1 includes a casing 10 having a front surface on which an opening 20 is formed. A feeding tray 21 and a discharging tray 30 are detachably attachable to the casing 10 through the opening 20. The feeding tray 21 is open upward and configured to accommodate therein a plurality of sheets P. Size of the sheets P may be the A4-size, for example. As illustrated in FIG. 2, the discharging tray 30 is disposed above the feeding tray 21. The discharging tray 30 is also open upward and is provided for accommodating therein sheets P (as well as first sheets P1 or second sheets P2 described later) that are finally discharged from the printing device 1.

An operating unit 125 having a display screen is also provided on the front surface of the casing 10. The operating unit 125 is configured of a touchscreen, for example. Through touch operations on the touchscreen, a user can perform various settings for printing on the printing device 1 and can enter input information. Input information entered through operations on the operating unit 125 includes information related to a size and a type (normal paper, glossy paper, card stock (thick paper), etc.) of the sheets P, for example. Through an operation on the operating unit 125, this input information is outputted to a controller 130 (see FIG. 5).

A rear tray 22 (described later) is provided on a rear surface of the casing 10. Second sheets P2 are conveyed into the rear tray 22 through a fourth conveying passage R4 and a second conveying passage R2 described later.

As illustrated in FIG. 2, the printing device 1 is further provided with a first feeding roller 23, a feeding arm 24, a first conveying passage R1, a registration roller 60, a first conveying roller 62, a reversing roller 64, a discharging roller 66, a second conveying roller 68, a first flap 51, a second flap 52, the third flap 53, the second conveying passage R2, a third conveying passage R3, the fourth conveying passage R4, a cutting unit 100, and a second feeding roller 27. The numbers of rollers provided along each of the first to fourth conveying passages R1 to R4 may be adjusted arbitrary.

The first feeding roller 23 functions to feed sheets P accommodated in the feeding tray 21 onto the first conveying passage R1. The first feeding roller 23 is rotatably supported by a distal end of the feeding arm 24. The feeding arm 24 is pivotally movably supported by a shaft 25, which in turn is supported in a frame of the printing device 1. The first feeding roller 23 makes forward rotation when driven by a feeding motor 111 (see FIG. 5). By making forward rotation, the first feeding roller 23 feeds sheets P accommodated in the feeding tray 21 onto the first conveying passage R1 one by one.

The first conveying passage R1 is a passage along which sheets P are conveyed from the feeding tray 21 to a platen 4 (described later). The first conveying passage R1 extends upward from a rear end of the feeding tray 21, is curved in a region defined by guide members 41 and 42, the first flap 51, and the third flap 53, and reaches an image recording unit 3 disposed above the platen 4.

The registration roller 60 is disposed along the first conveying passage R1 at a position downstream of the third flap 53 in a first direction D1. A pinch roller 61 is disposed at a position below and facing the registration roller 60. The registration roller 60 is driven by a conveying motor 112 (see FIG. 5) to be rotated. The pinch roller 61 is rotated in accordance with rotation of the registration roller 60. While a sheet P is nipped between the registration roller 60 and the pinch roller 61, forward rotation of the registration roller 60 and the pinch roller 61 conveys the sheet P to the image recording unit 3.

The image recording unit 3 is disposed above the feeding tray 21 and is positioned between the registration roller 60 and the first conveying roller 62 along the first conveying passage R1. The image recording unit 3 is configured to record images on sheets P. The image recording unit 3 includes a carriage 31, a recording head 32, and a plurality of nozzles 33. The recording head 32 is mounted on the carriage 31. The plurality of nozzles 33 is formed in a lower surface of the recording head 32. The recording head 32 is configured to eject ink droplets through the nozzles 33.

As illustrated in FIG. 2, the platen 4 is disposed below the image recording unit 3. Specifically, the platen 4 is positioned between the image recording unit 3 and the feeding tray 21 in the up-down direction with respect to the printing device 1.

The platen 4 is a rectangular plate-shaped member by which sheets P are supported. Specifically, the platen 4 is configured to support one surface of a sheet P conveyed in the first direction D1. The recording head 32 records an image on a sheet P supported by the platen 4 by selectively ejecting ink droplets onto the sheet P through the nozzles 33 while the carriage 31 is moved relative to the sheet P.

A carriage motor 113 (see FIG. 5) is configure to transmit a drive force to the carriage 31 for reciprocally moving the carriage 31 in directions orthogonal to the first direction D1, i.e., in a width direction of the sheet P. When recording an image on a sheet P, the controller 130 alternately executes a recording process to record an image for one line on the sheet P, and a line feed process to convey the sheet P by a prescribed feed amount. In the recording process, the controller 130 controls the carriage 31 to be moved along the width direction of the sheet P and controls the recording head 32 to eject ink droplets through the nozzles 33 while conveyance of the sheet P is halted. In the line feed process, the controller 130 drives the registration roller 60 and the first conveying roller 62 to convey the sheet P in the first direction D1.

The third conveying passage R3 is a passage for conveying sheets P from the platen 4 to the discharging tray 30. The first conveying roller 62 is disposed along the third conveying passage R3 arrayed with the platen 4 in the first direction D1. A spur roller 63 is disposed above and facing the first conveying roller 62. The conveying motor 112 (see FIG. 5) drives the first conveying roller 62 to be rotated. The spur roller 63 is rotated following rotation of the first conveying roller 62. When the first conveying roller 62 and the spur roller 63 make forward rotation while a sheet P is nipped between the first conveying roller 62 and the spur roller 63, the sheet P is conveyed in the first direction D1.

The reversing roller 64 is disposed along the third conveying passage R3 at a position downstream of the first conveying roller 62 in the first direction D1. A spur roller 65 is disposed at a position above and facing the reversing roller 64. The reversing roller 64 is driven by the conveying motor 112 to be rotated. The spur roller 65 is rotated along with rotation of the reversing roller 64. When a sheet P is nipped between the reversing roller 64 and the spur roller 65, forward rotation of the reversing roller 64 and the spur roller 65 cause the sheet P to be conveyed toward the cutting unit 100.

However, when the reversing roller 64 and the spur roller 65 make reverse rotation (rotated in a direction opposite a direction when making forward rotation), a sheet P nipped between the reversing roller 64 and the spur roller 65 is conveyed in a direction opposite the first direction D1. The sheet P being conveyed in reverse contacts the second flap 52 and is guided along a lower surface of the second flap 52 onto the fourth conveying passage R4.

As illustrated in FIG. 2, the first flap 51 is disposed at a merging position X of the first conveying passage R1 and the fourth conveying passage R4 (described later) so as to be pivotally movable. Specifically, the first flap 51 is pivotally movable between a first position (a position indicated by solid lines in FIG. 3) and a second position (a position indicated by solid lines in FIG. 2). When the first flap 51 is in the second position, the first flap 51 and the guide member 41 constitute a portion of the first conveying passage R1. When the first flap 51 is in the first position, the first flap 51 and the guide member 42 constitute a portion of the fourth conveying passage R4.

The second flap 52 is provided along the third conveying passage R3 between the first conveying roller 62 and the reversing roller 64. The second flap 52 is disposed at a position in the vicinity of a branching position Y and faces a guide member 43 from below. The second flap 52 is supported by the platen 4 to be pivotally movable between a first position (a position indicated by solid lines in FIG. 2) and a second position (a position indicated by dashed lines in FIG. 2). When in the first position, the second flap 52 contacts the guide member 43 to close the third conveying passage R3. When in the second position, the second flap 52 is pivotally moved downward from the first position and separated from the guide member 43 to allow passage of a sheet P conveyed in the first direction D1 through the third conveying passage R3.

The second flap 52 is urged upward by a coil spring 50. The coil spring 50 has one end connected to the second flap 52, and another end connected to the platen 4. Due to an urging force of the coil spring 50, the second flap 52 is maintained in the first position while its distal end contacts the guide member 43.

The third flap 53 is provided along the first conveying passage R1 upstream of the image recording unit 3 in the first direction D1. The third flap 53 is a crescent-shaped guide member pivotally movable between the first position (a position indicated by solid lines in FIG. 2) and the second position (a position indicated by solid lines in FIG. 3). In the first position, the third flap 53 guides sheets P to the image recording unit 3 along the first direction D1. In the second position, the third flap 53 guides a second sheet P2 toward the rear tray 22 along a second direction D2 while preventing the second sheet P2 from being conveyed toward the image recording unit 3 after passing through the fourth conveying passage R4.

A solenoid 114 (see FIG. 5) serves as a drive source for pivotally moving the third flap 53. A pivot center of the third flap 53 is a center of the same. Specifically, the third flap 53 has two terminal ends in a longitudinal direction thereof, and the center of the third flap 53 is a position farthest from the two terminal ends. Also, distances between the two terminal ends and the center of the third flap 53 are the same as each other. With this configuration, a locus of pivotally movement of the third flap 53 can be minimized.

The cutting unit 100 is disposed along the third conveying passage R3 downstream of the reversing roller 64 in the first direction D1. The cutting unit 100 has a well-known cutter mechanism for cutting a sheet P after the image recording unit 3 has recorded an image thereon. More specifically, while a sheet P is nipped between the reversing roller 64 and the spur roller 65, and between the discharging roller 66 and a spur roller 67, the cutting unit 100 cuts through the sheet P at a prescribed position in the sheet P (hereinafter referred to as "cutting position") along the width direction of the sheet P by moving the cutter mechanism in the width direction of the sheet P.

Figure 4:
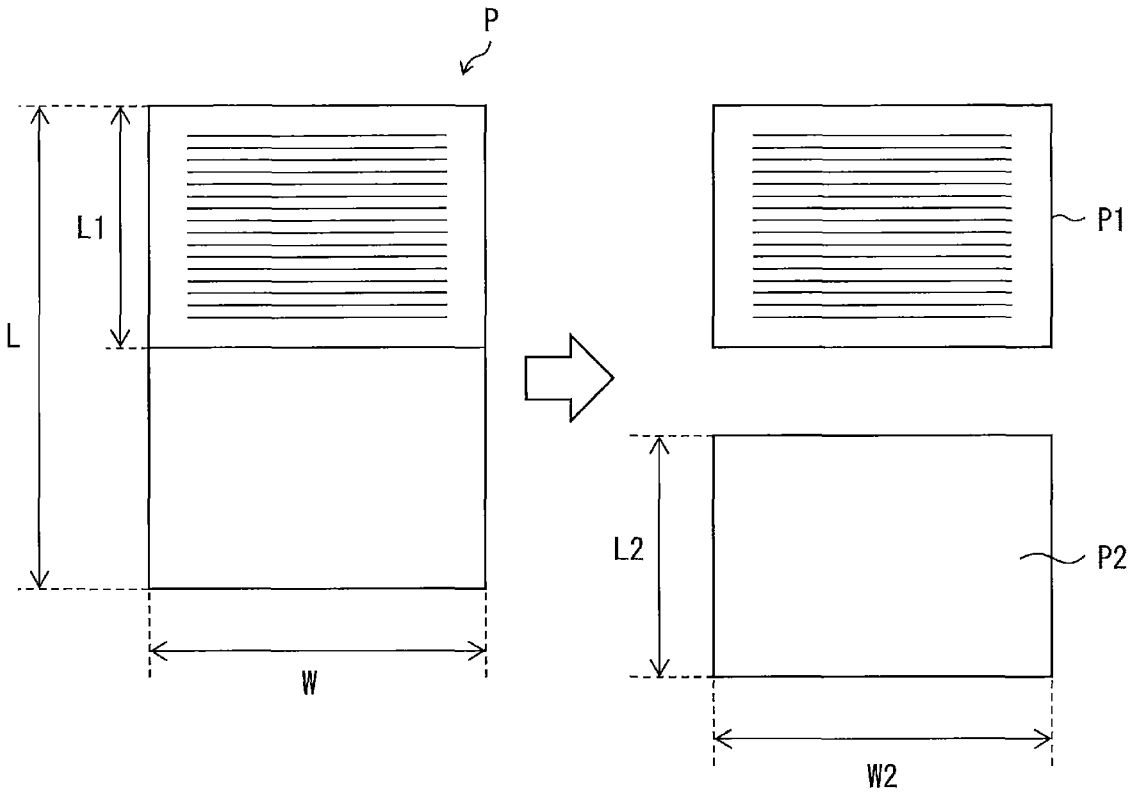
FIG. 4 is a view illustrating examples of a sheet prior to a cutting process, and first and second sheets obtained by cutting the sheet in the cutting process.
Figure 5:
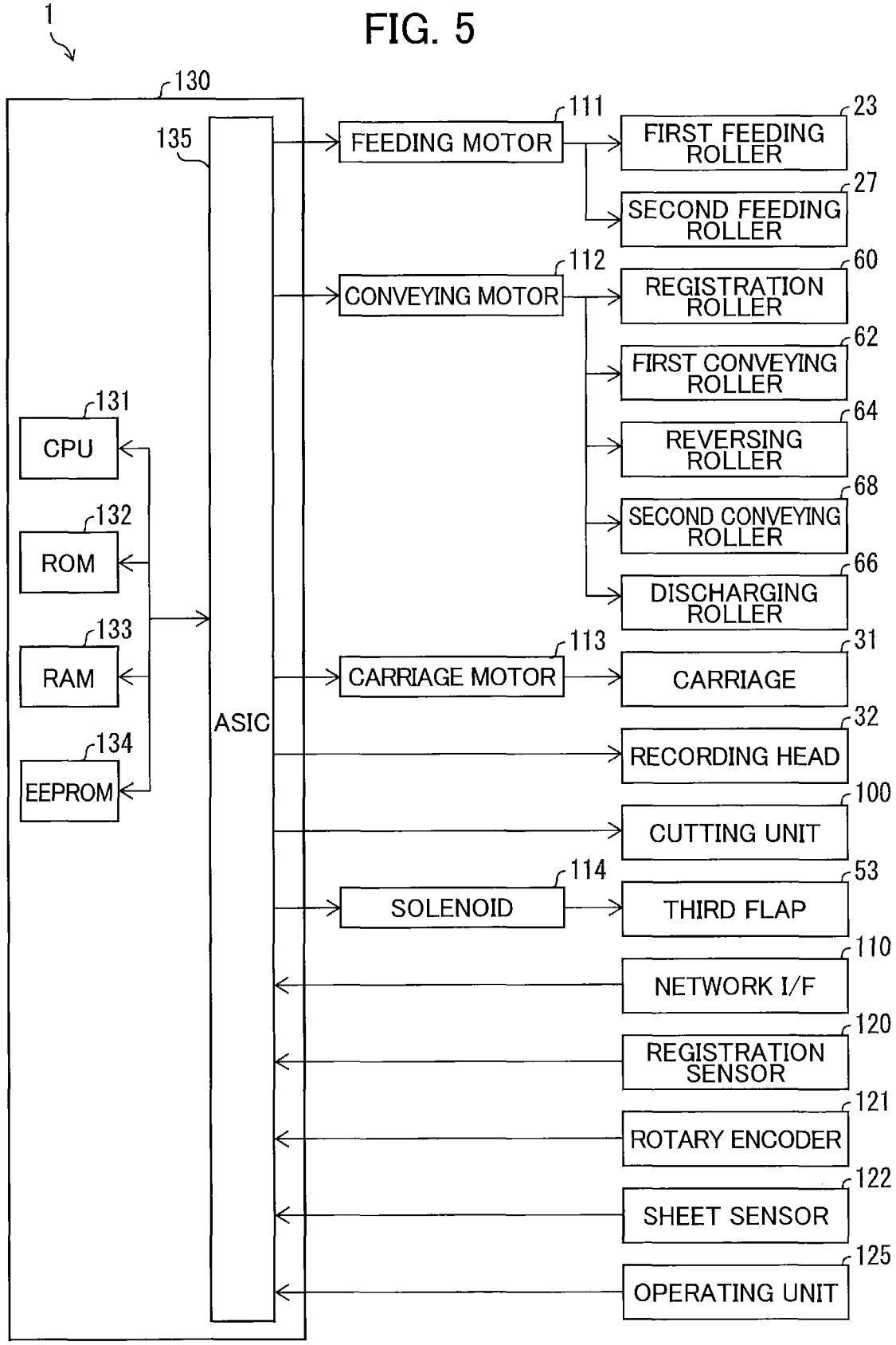
FIG. 5 is a block diagram illustrating an electrical configuration in the printing device according to the first embodiment.

When the controller 130 determines that a sheet P must be cut, the controller 130 controls the cutting unit 100 to cut the sheet P at the cutting position, thereby separating the sheet P into a first sheet P1 and a second sheet P2, as illustrated in FIG. 4.

The discharging roller 66 is disposed along the third conveying passage R3 at a position downstream of the cutting unit 100 in the first direction D1. The spur roller 67 is disposed at a position above and facing the discharging roller 66. The conveying motor 112 (see FIG. 5) drives the discharging roller 66 to be rotated. The spur roller 67 is rotatable following rotation of the discharging roller 66.

When a sheet P, a first sheet P1, or a second sheet P2 on which an image has been recorded is conveyed to the discharging roller 66 along guide members 44 and 45, forward rotation of the discharging roller 66 and the spur roller 67 allow the recorded sheet P, first sheet P1, or second sheet P2 to be discharged onto the discharging tray 30. In the meantime, when an image has not been recorded onto a second sheet P2 that is generated when a sheet P is cut by the cutting unit 100, the second sheet P2 is conveyed to the fourth conveying passage R4, and then is conveyed to the second conveying passage R2 to be accommodated in the rear tray 22.

A registration sensor 120 is disposed along the first conveying passage R1 at a position upstream of the registration roller 60. The registration sensor 120 is a sheet edge sensor. That is, the registration sensor 120 detects when a leading edge or a trailing edge of a sheet P passes a position for contacting the registration roller 60. The registration sensor 120 may be a sensor provided with an actuator that pivots when contacted by a sheet P, a photosensor, or the like.

The registration sensor 120 is configured to output an ON signal while a sheet P is passing the position of the registration sensor 120 and to output an OFF signal while a sheet P is not passing the position of the registration sensor 120. Hence, the registration sensor 120 outputs an ON signal from the timing that the leading edge of a sheet P reaches the position of the registration sensor 120 to the timing that the trailing edge of the same sheet P passes the position of the registration sensor 120 and outputs an OFF signal at all other times. Detection signals from the registration sensor 120 are outputted to the controller 130.

A rotary encoder 121 is provided on the registration roller 60 for detecting the rotation of the registration roller 60. The rotary encoder 121 outputs a pulse signal to the controller 130 upon rotation of the registration roller 60 (see FIG. 5).

The rotary encoder 121 has an encoder disc, and an optical sensor. The encoder disc is rotated along with the rotation of the registration roller 60. The optical sensor generates a pulse signal while reading the rotating encoder disc and outputs this pulse signal to the controller 130.

The fourth conveying passage R4 is a passage that branches from the third conveying passage R3 at the branching position Y and is connected to the first conveying passage R1 at the merging position X. The fourth conveying passage R4 is defined by guide members 71, 72, and 73, the second conveying roller 68, a pinch roller 69, and the like.

The second conveying roller 68 and the pinch roller 69 are disposed along the fourth conveying passage R4. The conveying motor 112 (see FIG. 5) drives the second conveying roller 68 to be rotated. The pinch roller 69 is rotated in accordance with rotation of the second conveying roller 68. After a sheet P has been cut by the cutting unit 100, the generated second sheet P2 passes through the fourth conveying passage R4 in the second direction D2 due to forward rotation of the second conveying roller 68 and is conveyed onto the second conveying passage R2. The second conveying passage R2 is a conveying passage that branches from the first conveying passage R1 in order to convey a second sheet P2 to the rear tray 22 after the second sheet P2 has passed through the fourth conveying passage R4.

The rear tray 22 is disposed upstream of the image recording unit 3 in the first direction D1. As illustrated in FIGS. 1 and 2, the rear tray 22 is provided with a support surface 220 for supporting the second sheet P2, a pair of left and right guide units 221 and 222. Also, the printing device 1 is further provided with a cover member 223 for covering the rear tray 22. Note that illustration of the cover member 223 is omitted in FIG. 1. The pair of guide units 221 and 222 contact and support respective edges of the second sheet P2 in the width direction. Specifically, the guide unit 221 contacts a right edge of the second sheet P2 and the guide unit 222 contacts a left edge of the second sheet P2.

A plurality of grooves extending along the left-right direction (not illustrated) is provided in the support surface 220. The guide units 221 and 222 are engaged with the grooves to be capable of moving in the left-right direction over an upper surface of the support surface 220 while being guided by the grooves. Specifically, the pair of guide units 221 and 222 is movable between a first state (a state indicated by solid lines in FIG. 1) in which the guide units 221 and 222 provide a prescribed length therebetween in the width direction, and a second state (a state indicated by dashed lines in FIG. 1) in which the guide units 221 and 222 provide a distance shorter than the prescribed length therebetween in the width direction. In the following description, the first state of the guide units 221 and 222 will also be referred to as an "open state" and the second state as a "closed state."

The rear tray 22 is configured so as to be pivotally movable between an inclined position illustrated in FIG. 1 and an upright position (illustration is omitted). In the inclined position, the rear tray 22 is tilted rearward by a prescribed angle relative to the rear tray 22 in the upright position. The inclination angle of the rear tray 22 in the inclined position may be modified as needed. For example, the rear tray 22 may be inclined relative to the rear tray 22 in the upright position by 90 degrees.

As illustrated in FIGS. 2 and 3, the cover member 223 is provided on the rear tray 22 to cover a periphery forming an opening of the rear tray 22. The cover member 223 is movable to open and close the opening of the rear tray 22 as indicated by arrows in FIGS. 2 and 3. The cover member 223 is configured of a clear resin member, for example, to enable the user to see contents in the rear tray 22 from an outside. By opening the cover member 223, the user can retrieve second sheets P2 from the rear tray 22.

The second feeding roller 27 is also provided in the rear tray 22. A spur roller 28 is disposed in a position facing the second feeding roller 27. The feeding motor 111 (see FIG. 5) drives the second feeding roller 27 to be rotated. The spur roller 28 is rotated along with rotation of the second feeding roller 27. By making forward rotation, i.e., by rotating counterclockwise in FIG. 2, the second feeding roller 27 feeds a second sheet P2 accommodated in the rear tray 22 onto the first conveying passage R1. Conversely, by making reverse rotation, i.e., rotating clockwise in FIG. 2, the second feeding roller 27 conveys a second sheet P2 into the rear tray 22 after the second sheet P2 has passed through the fourth conveying passage R4.

Thus, the second feeding roller 27 makes forward rotation when feeding a second sheet P2 from the rear tray 22 onto the first conveying passage R1. Conversely, the second feeding roller 27 makes reverse rotation when conveying a second sheet P2 into the rear tray 22.

A guide member 74 is provided between the second feeding roller 27 and the registration roller 60. The guide member 74 is positioned above the third flap 53 and is separated from the same. The guide member 74 is provided to guide second sheets P2 fed from the rear tray 22 toward the image recording unit 3 along the first conveying passage R1.

As illustrated in FIG. 2, a sheet sensor 122 is also provided in the rear tray 22. The sheet sensor 122 is configured to detect whether second sheet(s) P2 is present in the rear tray 22. The sheet sensor 122 is configured of a photosensor having a light-emitting element and a light-receiving element, for example. The sheet sensor 122 is configured to output an ON signal to the controller 130 when second sheet(s) P2 is present in the rear tray 22, and to output an OFF signal to the controller 130 when second sheet(s) P2 is not present in the rear tray 22.

<Electrical Configuration of Printing Device>

The controller 130 includes a central processing unit (CPU) 131, a read-only memory (ROM) 132, a random-access memory (RAM) 133, an EEPROM (registered trademark) 134, and an application-specific integrated circuit (ASIC) 135 that are all interconnected via an internal bus. The ROM 132 stores therein programs and the like for the CPU 131 to execute various operations. The RAM 133 is used as a storage area for temporarily storing data, signals, and the like used when the CPU 131 executes the programs described above, and a work area for data processing. The EEPROM 134 stores therein settings information that must be preserved after power to the printing device 1 is turned off. The controller 130 controls the feeding motor 111, the conveying motor 112, the carriage motor 113, the recording head 32, the cutting unit 100, and the like based on a control program read from the ROM 132.

The ASIC 135 is connected to the feeding motor 111, the conveying motor 112, the carriage motor 113, the recording head 32, the cutting unit 100, the solenoid 114, a network interface 110 (abbreviated as "network IF" in FIG. 5), the registration sensor 120, the rotary encoder 121, the sheet sensor 122, and the operating unit 125. The ASIC 135 supplies drive currents to the feeding motor 111, the conveying motor 112, and the carriage motor 113. The controller 130 controls the feeding motor 111, the conveying motor 112, and the carriage motor 113 to be driven through pulse width modulation (PWM) control, for example.

The controller 130 also applies drive voltages to vibrating elements in the recording head 32 to eject ink droplets through the nozzles 33. Since the ASIC 135 is also connected to the registration sensor 120, the rotary encoder 121, and the sheet sensor 122, the controller 130 can detect states of the printing device 1 based on signals outputted from the registration sensor 120, the rotary encoder 121, and the sheet sensor 122.

Specifically, the controller 130 detects whether sheets P and second sheets P2 have passed the contact position with the registration roller 60 based on a detection signal outputted from the registration sensor 120. The controller 130 also detects a rotated amount of the registration roller 60 based on pulse signals outputted from the rotary encoder 121. The controller 130 estimates a conveyance amount of the sheet P along the first conveying passage R1 based on pulse signals outputted from the rotary encoder 121 after the registration sensor 120 outputted an ON signal. The controller 130 also detects whether second sheet(s) P2 is present in the rear tray 22 based on a detection signal outputted from the sheet sensor 122.

The network interface 110 can be connected to a LAN or other network in order for the printing device 1 to be connected to an external device on which a driver for the printing device 1 has been installed. The printing device 1 can receive a print job, via the network interface 110, that includes identification information for identifying a type of sheet P. Upon receiving a print job via the network interface 110, the controller 130 controls the components in the printing device 1 to record images on sheets P according to a print command in the print job.

<Process of Controlling Printing Device>

Figure 6:
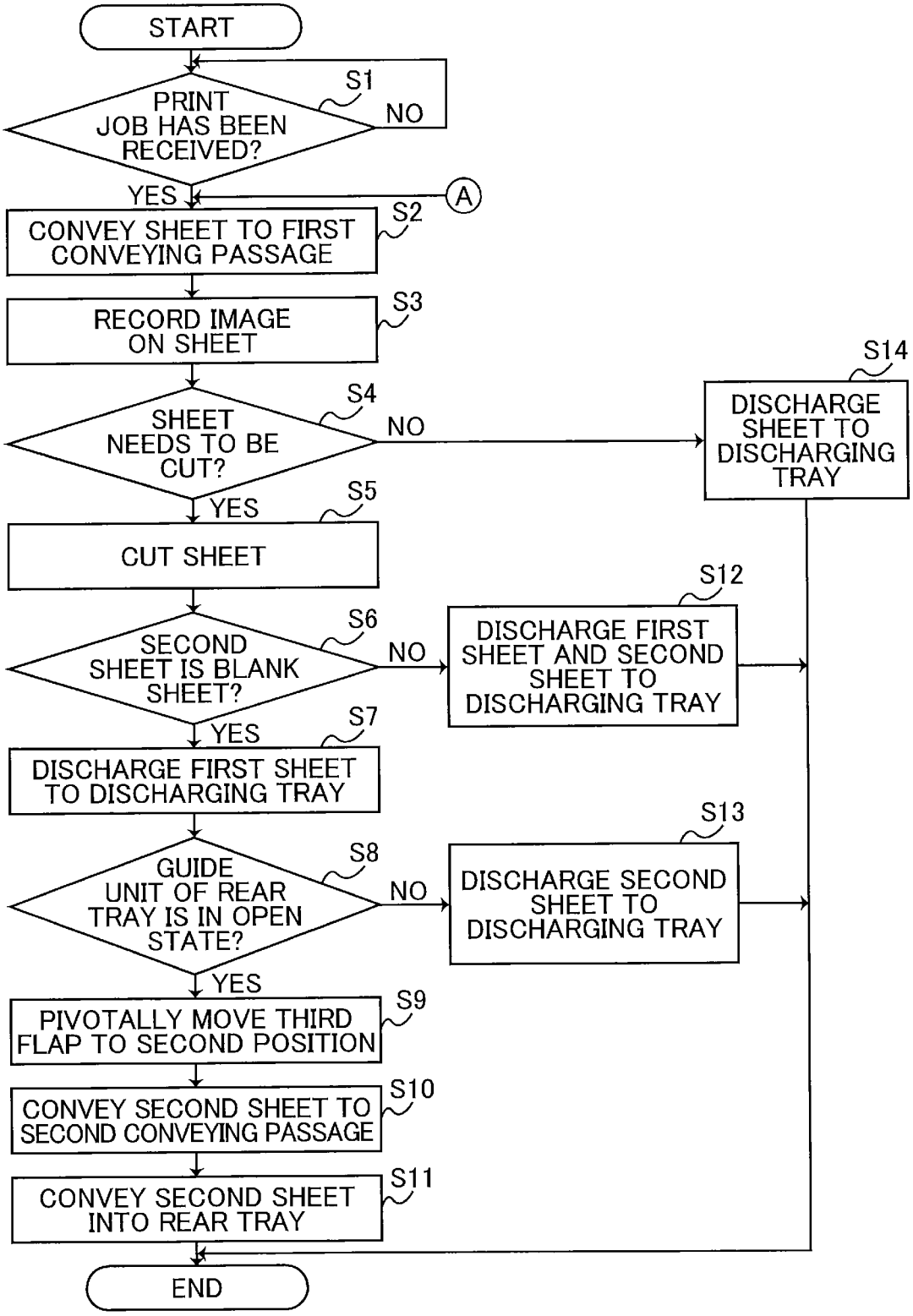
FIG. 6 is a flowchart illustrating steps in a process performed by a controller in the printing device according to the first embodiment.
Figure 7:
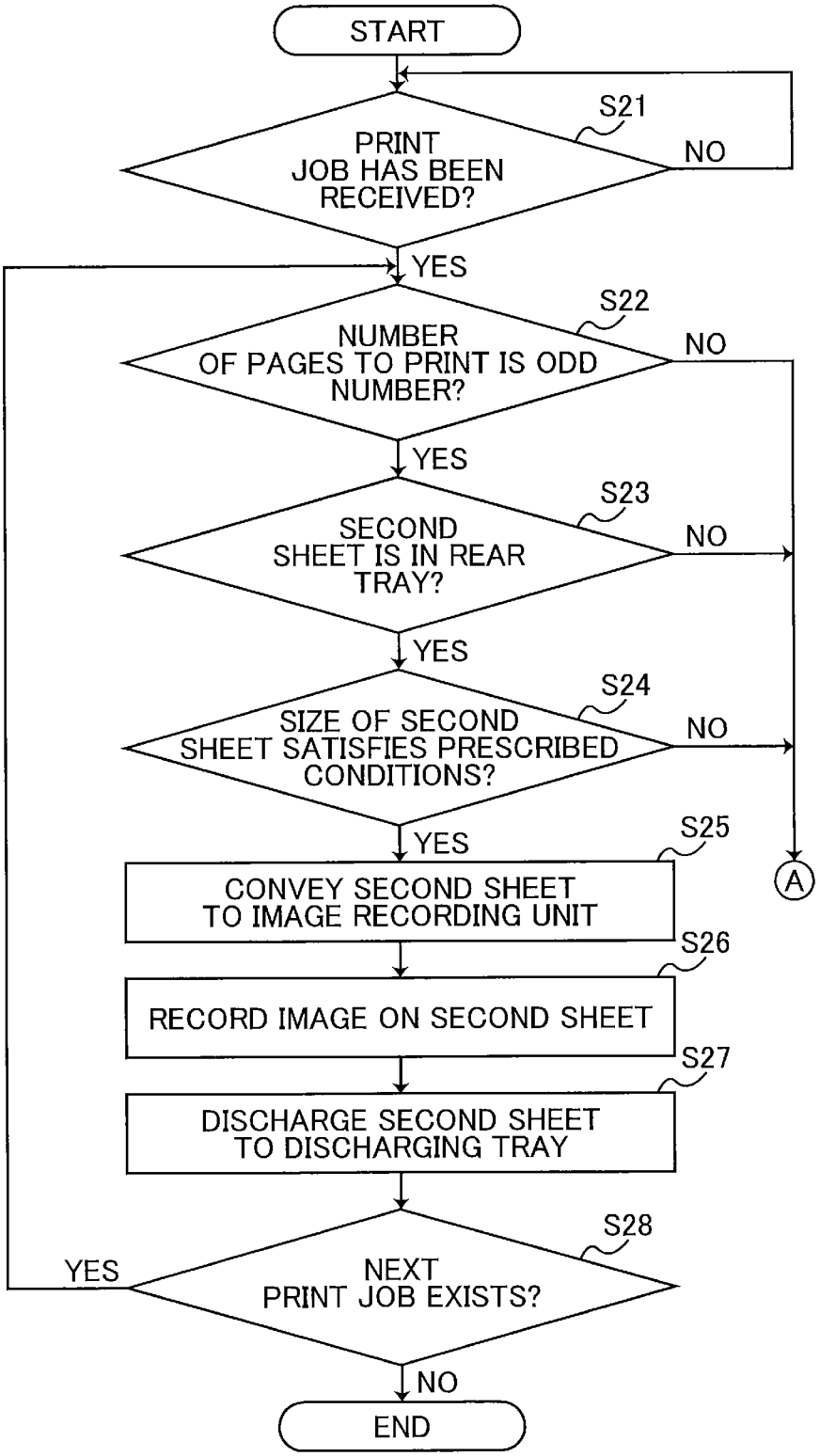
FIG. 7 is a flowchart illustrating steps in another process performed by the controller in the printing device according to the first embodiment.

Next, a process executed by the printing device 1 according to the first embodiment when a printing process is performed will be described with reference to the flowcharts in FIGS. 6 and 7. FIGS. 6 and 7 illustrate steps in a process executed by the controller 130 of the printing device 1 when a printing process is performed.

In the following description for the flowchart in FIG. 6, it will be assumed that the rear tray 22 does not yet accommodate therein any second sheets P2. In S1 at the beginning of the process in FIG. 6, the controller 130 determines whether a print job has been received via the network interface 110 or the like. Here, the print job includes such printing conditions as the size and type of sheets P to be printed, the number of pages to print, and whether color printing or monochromatic printing it to be performed, for example.

While a print job has not yet been received (S1: NO), the controller 130 repeats determination in the process of S1. When the controller 130 determines that a print job has been received (S1: YES), in S2 the controller 130 conveys a sheet P onto the first conveying passage R1. Specifically, the controller 130 drives the feeding motor 111 to rotate the first feeding roller 23 forward in order to convey a sheet P from the feeding tray 21 onto the first conveying passage R1.

When the leading edge of the sheet P conveyed onto the first conveying passage R1 contacts the first flap 51, the first flap 51, which has been maintained in the first position (see FIG. 3) by its own weight, is pivotally moved from the first position to the second position (see FIG. 2) owing to a pressure from the sheet P. In this way, the first flap 51 guides the sheet P conveyed in the first direction D1 downstream of the merging position X in the first direction D1 along the curved guide member 41. Note that, after the trailing edge of the sheet P passes the first flap 51, the first flap 51 is pivotally moved back from the second position to the first position by its own weight (see FIG. 3).

Subsequently, the leading edge of the sheet P contacts the third flap 53 to cause the third flap 53 to be pivotally moved counterclockwise in FIG. 2. In other words, pressure from the sheet P displaces the third flap 53 to the first position indicated by solid lines in FIG. 2. Note that, after the sheet P passes, the third flap 53 is returned to its original position (indicated by dashed lines in FIG. 2) by its own weight.

Next, when the leading edge of the sheet P reaches the registration roller 60, the controller 130 drives the conveying motor 112 to be rotated forward in order that the registration roller 60, the first conveying roller 62, the reversing roller 64, and the discharging roller 66 make forward rotation for conveying the leading edge side of the sheet P toward the image recording unit 3.

Note that the controller 130 determines whether the leading edge of the sheet P has reached the registration roller 60 by detecting when the rotated amount of the first feeding roller 23 has reached a prescribed amount required for conveying the sheet P from the feeding tray 21 to the registration roller 60. The controller 130 detects the rotated amount of the first feeding roller 23 based on pulse signals inputted from the rotary encoder 121 provided on the first feeding roller 23.

When the sheet P is conveyed to the image recording unit 3, in S3 the controller 130 controls the image recording unit 3 to record an image on the sheet P. Specifically, the controller 130 records an image on the sheet P by repeatedly performing the line feed process and the recording process described next. In the line feed process, the controller 130 drives the conveying motor 112 to make forward rotation to rotate the registration roller 60, the first conveying roller 62, the reversing roller 64, and the discharging roller 66, thereby conveying the sheet P by a prescribed feed amount in the first direction D1. In the recording process, the controller 130 drives the carriage motor 113 while conveyance of the sheet P is halted and records an image of one line by the recording head 32 ejecting ink droplets onto the sheet P through the nozzles 33.

In S4 the controller 130 determines whether the sheet P needs to be cut. For example, the controller 130 determines that cutting of the sheet P is necessary when the size of the print data specified in the print job (A5, for example) is smaller than the size of the sheets P accommodated in the feeding tray 21 (A4, for example).

When the controller 130 determines that the sheet P needs to be cut (S4: YES), in S5 the controller 130 controls the cutting unit 100 to cut the sheet P. By cutting the sheet P with the cutting unit 100, the controller 130 generates a first sheet P1 and a second sheet P2 having one-half the size of the sheet P, as illustrated in FIG. 4. When an image is not recorded on the second sheet P2, the blank second sheet P2 can be reused.

Hence, in S6 the controller 130 determines whether the second sheet P2 is blank. When the controller 130 determines that the second sheet P2 is a blank sheet (S6: YES), in S7 the controller 130 controls the conveying motor 112 to rotate the discharging roller 66 forward in order to convey the first sheet P1 into the discharging tray 30. Subsequently in S8, the controller 130 determines whether the pair of guide units 221 and 222 of the rear tray 22 is in the open state (i.e., the first state).

When the controller 130 determines that the pair of guide units 221 and 222 of the rear tray 22 is in the open state (S8:

YES), in S9 the controller 130 drives the solenoid 114 to pivotally move the third flap 53 to the second position illustrated in FIG. 3.

Subsequently, in S10 the controller 130 conveys the second sheet P2 onto the second conveying passage R2. Specifically, the controller 130 drives the conveying motor 112 in reverse in order to cause the reversing roller 64 to make reverse rotation, whereby the second sheet P2 is conveyed along the third conveying passage R3 in the direction opposite the first direction D1. When the second sheet P2 is conveyed along the third conveying passage R3 in the direction opposite the first direction D1, the second flap 52 is maintained in the first position by the urging force of the coil spring 50. That is, the second flap 52 is in a state for closing the first conveying passage R1. Therefore, the second sheet P2 being conveyed in the reverse direction through the third conveying passage R3 is guided along the lower surface of the second flap 52 onto the fourth conveying passage R4.

As the controller 130 controls the reversing roller 64 to make reverse rotation, a leading edge and a trailing edge of the second sheet P2 is switched prior to a state in which the reversing roller 64 makes reverse rotation. Specifically, a trailing edge of the second sheet P2 in the first direction D1 when the second sheet P2 is conveyed along the third conveying passage R3 in the first direction D1 becomes a leading edge of the second sheet P2 when the second sheet P2 is conveyed along the fourth conveying passage R4 into the rear tray 22 (i.e., after the reversing roller 64 makes reverse rotation).

By rotating the second conveying roller 68, the controller 130 conveys the second sheet P2 along the fourth conveying passage R4 in the second direction D2. At this time, the first flap 51 is in the first position, and the third flap 53 is in the second position, as illustrated in FIG. 3. Consequently, the second sheet P2 is not conveyed in the first direction D1 but rather is conveyed toward the second feeding roller 27 in the rear tray 22 through the second conveying passage R2. In S11 the controller 130 controls the second feeding roller 27 to make reverse rotation to convey the second sheet P2 into the rear tray 22.

On the other hand, when the controller 130 determines that an image is recorded on the second sheet P2 in S6, i.e., when the second sheet P2 is not blank (S6: NO), in S12 the controller 130 controls the conveying motor 112 to cause the registration roller 60, the first conveying roller 62, the reversing roller 64, and the discharging roller 66 to make forward rotation, thereby discharging both the first sheet P1 and second sheet P2 into the discharging tray 30. When a plurality of pages is included in one print job, the controller 130 repeats the process in S2 to S6 and S12 until an image is recorded on the last page in the print job.

Further, when the controller 130 determines in S8 that the pair of guide units 221 and 222 of the rear tray 22 is in the second state, i.e., the closed state (S8: NO), in S13 the controller 130 discharges the second sheet P2 into the discharging tray 30 rather than conveying the second sheet P2 into the rear tray 22. Specifically, the controller 130 conveys the second sheet P2 in the first direction D1 and discharges the second sheet P2 into the discharging tray 30.

Further, when the controller 130 determines in S4 that the sheet P does not need to be cut (S4: NO), in S14 the controller 130 controls the conveying motor 112 to cause the registration roller 60, the first conveying roller 62, the reversing roller 64, and the discharging roller 66 to make forward rotation in order to convey the uncut sheet P in the first direction D1 and to discharge the sheet P into the discharging tray 30. Note that, when a plurality of pages is included in one print job, the controller 130 repeats the process in S2 to S4 and S14 until an image is recorded on the last page in the print job. After completing the steps in the flowchart of FIG. 6, the process advances to the flowchart illustrated in FIG. 7.

In S21 of the process in FIG. 7, the controller 130 determines whether a print job has been received via the network interface 110. While a print job has not been received (S21: NO), the controller 130 returns to the process in S21. On the other hand, when the controller 130 determines that a print job has been received (S21: YES), in S22 the controller 130 determines whether the number of pages to print in the print job is an odd number. When the controller 130 determines that the number of pages to print is odd (S22: YES), in S23 the controller 130 determines whether second sheets P2 are present in the rear tray 22 based on the detection signal outputted from the sheet sensor 122.

When the controller 130 determines that second sheets P2 are present in the rear tray 22 (S23: YES), in S24 the controller 130 determines whether the size of the second sheet P2 satisfies prescribed conditions. The prescribed conditions may be that the size of the second sheets P2 is greater than or equal to the size of print data specified in the print job, for example.

Here, the size of the second sheet P2 is defined by a length L2 in the conveying direction and a width W2 in the width direction, as illustrated in FIG. 4. The length L2 of the second sheet P2 is found by subtracting a length L1 of the first sheet P1 from a length L of the sheet P (L2=L−L1), while the width W2 of the second sheet P2 is equivalent to a width W of the sheet P (W2=W). The length L and the width W of the sheets P are defined by standard sizes. Also, the length L1 and a width of the first sheet P1 are determined by the size of print data specified in the print job.

The length L1 of the first sheet P1 in the conveying direction is found based on pulse signals outputted from the rotary encoder 121 from the timing that the registration sensor 120 detects the leading edge of the sheet P to the timing that the image recording unit 3 completes image recording. Thus, the controller 130 can detect the size of the second sheets P2 through this process.

When the controller 130 determines that the size of the second sheets P2 satisfies the prescribed conditions (S24: YES), in S25 the controller 130 conveys the second sheet P2 to the image recording unit 3. Specifically, the controller 130 controls the feeding motor 111 to rotate the second feeding roller 27 forward in order to convey the second sheet P2 from the rear tray 22 onto the first conveying passage R1 along the first direction D1. At this time, the third flap 53 is in its original position (the position indicated by dashed lines in FIG. 2) due to its own weight. The second sheet P2 is guided along the guide member 74 and an upper surface of the third flap 53 and conveyed toward the registration roller 60.

On the other hand, when the controller 130 determines that the number of pages to print is an even number (S22: NO) or when the controller 130 determines that second sheet P2 is not present in the rear tray 22 (S23: NO), the controller 130 returns to S2 in FIG. 6 and conveys a sheet P from the feeding tray 21 onto the first conveying passage R1. Additionally, when the controller 130 determines that the size of the second sheets P2 accommodated in the rear tray 22 does not satisfy the prescribed conditions (S24: NO), the controller 130 returns to S2 in FIG. 6.

After completing the process in S25, in S26 the controller 130 controls the image recording unit 3 to record an image on the second sheet P2. Since the second sheet P2 accommodated in the rear tray 22 has passed through the second conveying passage R2, the front-back surfaces of the second sheet P2 are not inverted from a state prior to passing through the second conveying passage R2. Accordingly, the controller 130 can record an image on a front surface of the second sheet P2, i.e., the same surface on which an image has been recorded on the first sheet P1. Thus, in a case where the sheet P is glossy paper, for example, the printing device 1 can record an image on the glossy surface.

In S27 the controller 130 causes the registration roller 60, the first conveying roller 62, the reversing roller 64, and the discharging roller 66 to make forward rotation in order to discharge the second sheet P2 into the discharging tray 30. When a print job includes other images to be printed on a second sheet P2, the controller 130 repeatedly executes the process in S25 to S27 until the last page is printed on a second sheet P2.

In S28 the controller 130 determines whether another print job exists. When the controller 130 determines that another print job exists (S28: YES), the controller 130 returns to the process of S22. When the controller 130 determines that another print job does not exist (S28: NO), the controller 130 ends the process in FIG. 7.

Effects of First Embodiment

With the printing device 1 according to the first embodiment described above, the printing device 1 can be made more compact in its height dimension by arranging the rear tray 22 upstream of the image recording unit 3 in the first direction D1 so as not to overlap the feeding tray 21 in the up-down direction with respect to the printing device 1. With this configuration, the printing device 1 can be made compact and second sheets P2 generated when cutting sheets P can be conveyed into the rear tray 22 for reuse.

Further, the printing device 1 is provided with the third conveying passage R3 for conveying sheets P from the platen 4 to the discharging tray 30, and the fourth conveying passage R4 that branches from the third conveying passage R3 at the branching position Y and is connected to the first conveying passage R1 at the merging position X for conveying second sheets P2. Thus, a second sheet P2 passes through the fourth conveying passage R4 before conveyed into the rear tray 22, thereby avoiding the occurrence of a paper jam or staining of the second sheet P2 due to the second sheet P2 coming into contact with the platen 4.

Further, second sheets P2 conveyed into the rear tray 22 have not been inverted front-to-back from the state prior to being conveyed onto the second conveying passage R2. Hence, when a second sheet P2 is conveyed from the rear tray 22, the printing device 1 can perform printing on the same surface of the second sheet P2 that has been printed on the first sheet P1. When the sheet P is glossy paper or the like, the printing device 1 will print only on the glossy surface.

Further, by displacing the third flap 53 from the first position to the second position, the printing device 1 can reliably convey second sheets P2 into the rear tray 22 while preventing second sheets P2 that have been conveyed onto the second conveying passage R2 from being conveyed toward the image recording unit 3. Further, by controlling drive of the solenoid 114, the controller 130 can quickly switch the position of the third flap 53 through a simple configuration.

Since the pivot center of the third flap 53 is the center of the third flap 53, the locus of pivotal movement of the third flap 53 can be minimized, thereby enabling the printing device 1 to be made more compact.

The opening of the rear tray 22 is covered with the cover member 223, which prevents dust and other foreign matter from entering the rear tray 22, thereby preventing dirt from becoming deposited on the second sheet P2.

When second sheets P2 are present in the rear tray 22 (S23: YES), the controller 130 conveys second sheets P2 from the rear tray 22 to the image recording unit 3 (S25) rather than conveying sheets P from the feeding tray 21, thereby prioritizing the use of second sheets P2 in the rear tray 22.

When the pair of guide units 221 and 222 of the rear tray 22 is in the second state in which the distance between the guide units 221 and 222 is shorter than the distance in the first state, i.e., when the guide units 221 and 222 are in the closed state (S8: NO), the controller 130 discharges the second sheet P2 into the discharging tray 30 rather than conveying the second sheet P2 into the rear tray 22 (S13). This process can prevent the occurrence of a paper jam caused by the second sheet P2 contacting the guide units 221 and 222.

Further, by the controller 130 controlling the drive of the second feeding roller 27, a second sheet P2 can be suitably conveyed toward the rear tray 22 until the second sheet P2 is accommodated in the rear tray 22 (S11), and the second sheet P2 can be fed from the rear tray 22 onto the first conveying passage R1 and conveyed toward the image recording unit 3 (S25).

Second Embodiment

Next, a printing device 1 according to a second embodiment of the present disclosure will be described with reference to FIG. 8. For convenience of description, members having the same function as members described in the first embodiment will be designated with the same reference numerals to avoid duplicating description.

In the printing device 1 according to the second embodiment, the rear tray 22 also serves as a manual feed tray capable of accommodating therein sheets P of various sizes. The rear tray 22 has the same configuration as described in the first embodiment and is supported so as to be able to open and close on a far-side wall portion of the casing 10 when viewing the casing 10 from the front side, i.e., the rear surface of the casing 10.

<Process of Controlling Printing Device>

Figure 8:
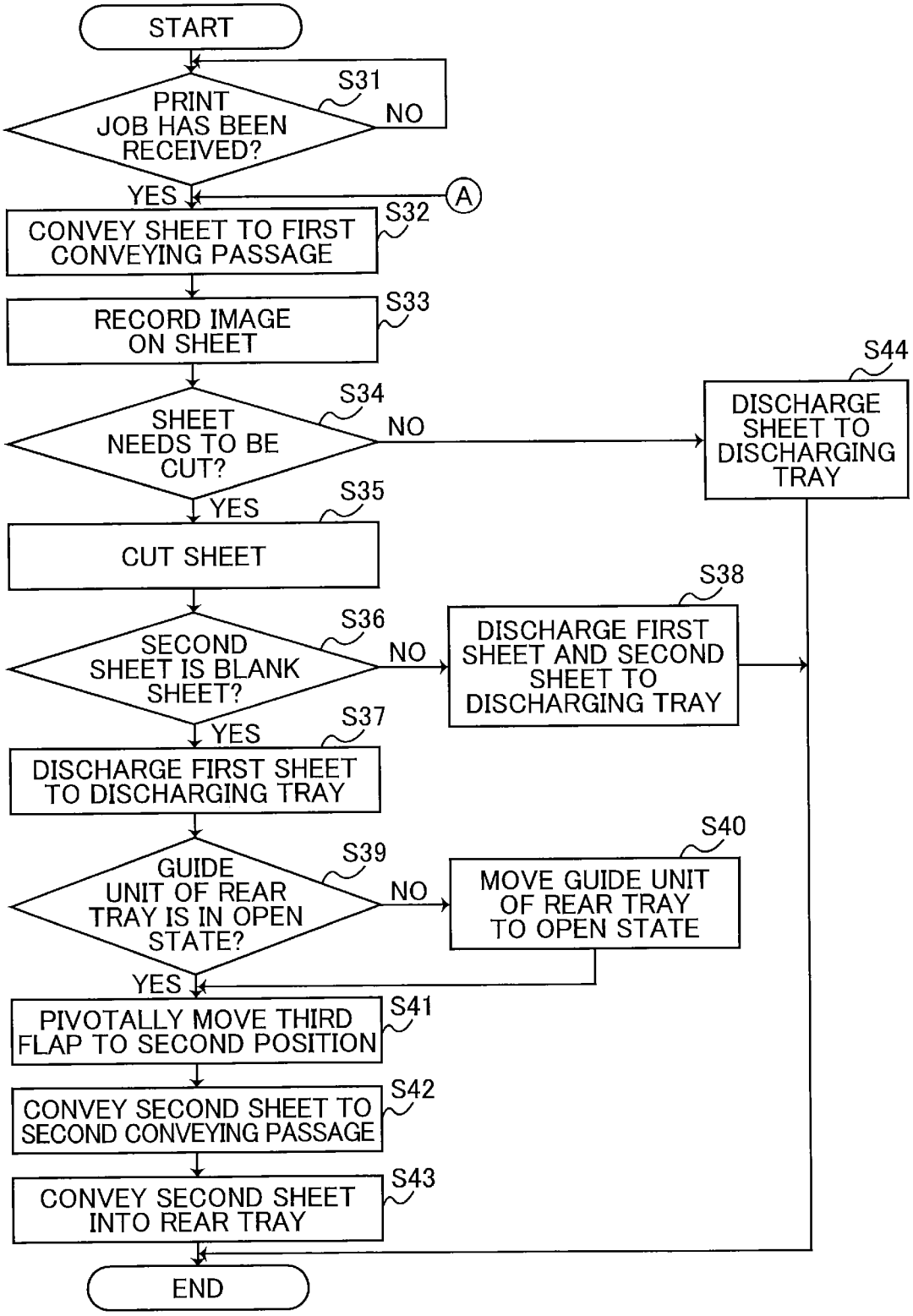
FIG. 8 is a flowchart illustrating steps in a process performed by a controller in a printing device according to a second embodiment of the present disclosure.

In the second embodiment, the controller 130 executes a process indicated by a flowchart in FIG. 8 in place of the process illustrated in FIG. 6 for the first embodiment. FIG. 8 is a flowchart illustrating steps in the process executed by the controller 130 of the printing device 1 according to the second embodiment when a printing process is performed.

In S31 at the beginning of the process in FIG. 8, the controller 130 determines whether a print job has been received. While the controller 130 determines that a print job has not been received (S31: NO), the controller 130 repeatedly executes the process in S31. When the controller 130 determines that a print job has been received (S31: YES), in S32 the controller 130 conveys a sheet P onto the first conveying passage R1. When the sheet P is conveyed to the image recording unit 3, in S33 the controller 130 controls the image recording unit 3 to record an image on the sheet P.

In S34 the controller 130 determines whether the sheet P needs to be cut. When the controller 130 determines that the sheet P must be cut (S34: YES), in S35 the controller 130 drives the cutting unit 100 to cut the sheet P. By cutting the sheet P with the cutting unit 100, the controller 130 generates a first sheet P1 and a second sheet P2 having one-half the size of the sheet P, as illustrated in FIG. 4. If an image is not recorded on the second sheet P2, the blank second sheet P2 can be reused.

Hence, in S36 the controller 130 determines whether the second sheet P2 is blank. When the controller 130 determines that the second sheet P2 is blank (S36: YES), in S37 the controller 130 discharges the first sheet P1 into the discharging tray 30. On the other hand, when the controller 130 determines that the second sheet P2 is not blank (S36: NO), in S38 the controller 130 discharges both the first sheet P1 and second sheet P2 into the discharging tray 30. When a plurality of pages is included in one print job, the controller 130 repeats the process in S32 to S36 and S42 until an image is recorded on the last page in the print job.

After completing the process in S37, in S39 the controller 130 determines whether the pair of guide units 221 and 222 of the rear tray 22 is in the open state. In the second embodiment, when the controller 130 determines in S39 that the pair of guide units 221 and 222 of the rear tray 22 is in the second state, i.e., the closed state (S39: NO), in S40 the controller 130 controls the pair of guide units 221 and 222 of the rear tray 22 to be moved the first state, i.e., the open state by driving a motor (not illustrated).

On the other hand, when the controller 130 determines that the pair of guide units 221 and 222 of the rear tray 22 is in the open state (S39: YES) or after completing the process in S40, in S41 the controller 130 pivotally moves the third flap 53 into the second position by controlling the solenoid 114, and in S42 conveys the second sheet P2 onto the second conveying passage R2. Then, in S43 the controller 130 controls the second feeding roller 27 to make reverse rotation to convey the second sheet P2 into the rear tray 22.

On the other hand, when the controller 130 determines in S34 that the sheet P does not need to be cut (S34: NO), in S44 the controller 130 conveys the uncut sheet P in the first direction D1 and discharges the sheet P into the discharging tray 30. When a plurality of pages is included in one print job, the controller 130 repeats the process in S32 to S34 and S34 until an image is recorded on the last page in the print job. This completes the process of the flowchart in FIG. 8.

In the printing device 1 according to the second embodiment described above, the rear tray 22 can double as a manual feed tray. Thus, when the pair of guide units 221 and 222 of the rear tray 22 is in the closed state, i.e., the second state (S39: NO), the controller 130 moves the guide units 221 and 222 to the open state, i.e., the first state (S40) and conveys the second sheet P2 into the rear tray 22. This operation prevents the second sheet P2 from contacting the guide units 221 and 222 of the rear tray 22 and causing a paper jam.

<Modifications>

In the printing device 1 according to the first embodiment described above, the rear tray 22 is disposed on the casing 10 so as to be pivotally movable relative to the casing 10. However, the rear tray 22 may be fixed to the casing 10, provided that the rear tray 22 can accommodate therein the second sheets P2.

In the printing device 1 according to the first embodiment described above, the solenoid 114 is used as the drive source for pivotally moving the third flap 53, but a motor or the like may be used as the drive source instead. In the latter case, the drive force of the motor is transmitted to the third flap 53 through a power transmission member. Thus, the controller 130 can control the pivotal movement of the third flap 53 by controlling the drive of the motor.

In the printing device 1 according to the first embodiment described above, roller members, i.e., the registration roller 60, the first conveying roller 62, the reversing roller 64, the discharging roller 66, and the second conveying roller 68 are used to convey sheets P, but a belt member, a drum member, and the like may be employed to convey sheets P instead.

The first embodiment describes a case in which the cutting unit 100 cuts the sheet P in half. However, the cutting position on the sheet P may be adjusted according to the size of the print data. For example, one-third of the sheet P may be cut.

In the embodiments described above, the printing device 1 receives print jobs via the network interface 110, but the printing device 1 may instead receive print jobs via a USB interface, for example.

While the description has been made in detail with reference to the embodiments, it would be apparent to those skilled in the art that the present disclosure is not limited to the embodiments described above many modifications and variations may be made thereto. Techniques described in each embodiment and modifications may be suitably combined.

REMARKS

The feeding tray 21 is an example of a first accommodating unit. The rear tray 22 is an example of a second accommodating unit. The sheet P is an example of a printing medium. The first sheet P1 is an example of a first medium. The second sheet P2 is an example of a second medium. The platen 4 is an example of a supporting unit. The one surface of the sheet P is an example of a first surface of the printing medium. The discharging tray 30 is an example of a discharging unit. The third flap 53 is an example of a flap. The second feeding roller 27, the registration roller 60, and the first conveying roller 62 are an example of a conveying unit. The sheet sensor 122 is an example of a medium sensor. The second feeding roller 27 is also an example of a feeding roller.

What is claimed is:

1. A printing device comprising:

a casing;

a first accommodating unit configured to accommodate therein a printing medium;

an image recording unit disposed above the first accommodating unit and configured to record an image on the printing medium;

a cutting unit configured to cut the printing medium to divide the printing medium into a first medium and a second medium;

a supporting unit disposed between the first accommodating unit and the image recording unit in an up-down direction and configured to support a first surface of the printing medium conveyed in a first direction;

a second accommodating unit positioned upstream of the image recording unit in the first direction and configured to accommodate therein the second medium obtained by cutting the printing medium using the cutting unit;

a first conveying passage along which the printing medium accommodated in the first accommodating unit is conveyed to the supporting unit; and a second conveying passage along which the second medium is conveyed to the second accommodating unit, the second conveying passage intersecting and crossing paths with the first conveying passage, wherein the second accommodating unit is offset from the first accommodating unit in the first direction, the first direction being orthogonal to the up-down direction.

2. The printing device according to claim 1, further comprising:

a discharging unit onto which the printing medium on which an image has been record using the image recording unit is discharged;

a third conveying passage along which the printing medium is conveyed from the supporting unit to the discharging unit; and a fourth conveying passage along which the second medium is conveyed from the third conveying passage to the first conveying passage, the fourth conveying passage branching from the third conveying passage at a branching position on the third conveying passage and being connected to the first conveying passage at a merging position on the first conveying passage.

3. The printing device according to claim 2, further comprising:

a reversing roller positioned downstream of the branching position in the first direction and configured to make forward rotation and reverse rotation; and a controller configured to perform:

controlling the reversing roller to convey the second medium to the second accommodating unit while switching a leading edge and a trailing edge of the second medium to each other such that an edge of the second medium that serves as a trailing edge in the first direction when the second medium is conveyed along the third conveying passage becomes a leading edge of the second medium when the second medium is conveyed into the second accommodating unit.

4. The printing device according to claim 3, further comprising a flap disposed along the first conveying passage at a position upstream of the image recording unit in the first direction, wherein the flap is pivotally movable between:

a first position in which the flap guides the printing medium to the image recording unit along the first direction; and a second position in which the flap guides the second medium conveyed in the second conveying passage to the second accommodating unit along a second direction.

5. The printing device according to claim 4, further comprising a drive source for pivotally moving the flap, the drive source comprising a solenoid, wherein the controller is configured to further perform:

controlling the solenoid to pivotally move the flap.

6. The printing device according to claim 4, further comprising a drive source for pivotally moving the flap, the drive source comprising a motor, wherein the controller is configured to further perform:

controlling the motor to pivotally move the flap.

7. The printing device according to claim 4, wherein a pivot center of the flap is a center of the flap.

8. The printing device according to claim 2, wherein the fourth conveying passage comprises a first end and a second end, and wherein both the first and the second end are nearer the first accommodating unit than the image recording unit.

9. The printing device according to claim 8, wherein the fourth conveying passage comprises an upstream portion and a downstream portion, wherein the upstream portion is positioned upstream of the image recording unit in the first direction and the downstream portion is positioned downstream of the image recording unit in the first direction.

10. The printing device according to claim 1, further comprising:

a conveying unit configured to convey the second medium;

a medium sensor configured to detect whether the second medium is present in the second accommodating unit; and a controller configured to perform:

controlling, when the medium sensor detects that the second medium is in the second accommodating unit, the conveying unit to convey the second medium to the image recording unit.

11. The printing device according to claim 10, wherein the second accommodating unit comprises a pair of guide units configured to support respective edges in a width direction of the second medium, wherein the pair of guide units is movable between:

a first state in which the pair of guide units provides a prescribed distance therebetween in the width direction; and a second state in which the pair of guide units provides a distance shorter than the prescribed distance therebetween in the width direction, wherein, when the pair of guide units is in the first state, the controller is configured to further perform:

conveying the second medium to the second accommodating unit, and wherein, when the pair of guide units is in the second state, the controller is configured to further perform:

discharging the second medium to an outside of the casing.

12. The printing device according to claim 10, wherein the second accommodating unit comprises a pair of guide units configured to support respective edges in a width direction of the second medium, wherein the pair of guide units is movable between:

a first state in which the pair of guide units provides a prescribed distance therebetween in the width direction; and a second state in which the pair of guide units provides a distance shorter than the prescribed distance therebetween in the width direction, wherein, when the pair of guide units is in the first state, the controller is configured to further perform:

conveying the second medium to the second accommodating unit, and wherein, when the pair of guide units is in the second state, the controller is configured to further perform:

moving the pair of guide units from the second state to the first state; and conveying, after performing the moving, the second medium to the second accommodating unit.

13. The printing device according to claim 10, wherein the conveying unit comprises a feeding roller disposed in the second accommodating unit and configured to make forward rotation and reverse rotation, the forward rotation of the feeding roller causing the second medium accommodated in the second accommodating unit to be fed to the first conveying passage, the reverse rotation of the feeding roller causing the second medium to be conveyed into the second accommodating unit, and wherein the controller is configured to further perform:

controlling the feeding roller to make the forward rotation to feed the second medium in the second accommodating unit to the first conveying passage; and controlling the feeding roller to make the reverse rotation to convey the second medium into the second accommodating unit.

14. The printing device according to claim 1, further comprising a cover member configured to cover a periphery of an opening of the second accommodating unit.

15. The printing device according to claim 1, wherein the second accommodating unit is a manual feed tray.

16. The printing device according to claim 1, further comprising:

a controller configured to perform:

controlling a conveying unit to feed the second medium into one of the first conveying passage and the second conveying passage.

* * * * *